United States Patent [19]

Flohr

[11] 4,184,204

[45] Jan. 15, 1980

[54] PROGRAMMABLE REFINER CONTROLLER

[75] Inventor: Gary R. Flohr, Pittsfield, Mass.

[73] Assignee: Beloit Corporation, Beloit, Wis.

[21] Appl. No.: 949,087

[22] Filed: Oct. 6, 1978

[51] Int. Cl.[2] ..... G06F 15/46; B02C 7/14; D21F 1/04

[52] U.S. Cl. ..... 364/471; 162/254; 162/263; 241/36; 241/37

[58] Field of Search ..... 364/471, 469, 118, 568; 162/198, 238, 252, 253, 254, 258, 259, 262, 263; 241/36, 37, 63, 64

[56] References Cited

U.S. PATENT DOCUMENTS

| | | | |
|---|---|---|---|
| 3,490,689 | 1/1970 | Hart et al. | 364/471 |
| 3,604,646 | 9/1971 | Keyes et al. | 241/37 |
| 3,622,448 | 11/1971 | Adams et al. | 364/471 X |
| 3,654,075 | 4/1972 | Keyes et al. | 162/254 |
| 3,711,688 | 1/1973 | Stout et al. | 364/471 |

*Primary Examiner*—Joseph F. Ruggiero

*Attorney, Agent, or Firm*—Hill, Van Santen, Steadman, Chiara & Simpson

[57] ABSTRACT

A micro-processor is useable which can be programmed so as to provide a controller for a refiner, for example, for a paper stock refiner in which flow and consistency transducers are utilized to measure these parameters of the paper stock and these signals are supplied to a programmable refinery controller which also receives an input of the power supplied to the refinery and supplies a control signal to the refiner so as to control the power supplied to the refinery. One or more fixed inputs may also be supplied to the controller.

6 Claims, 3 Drawing Figures

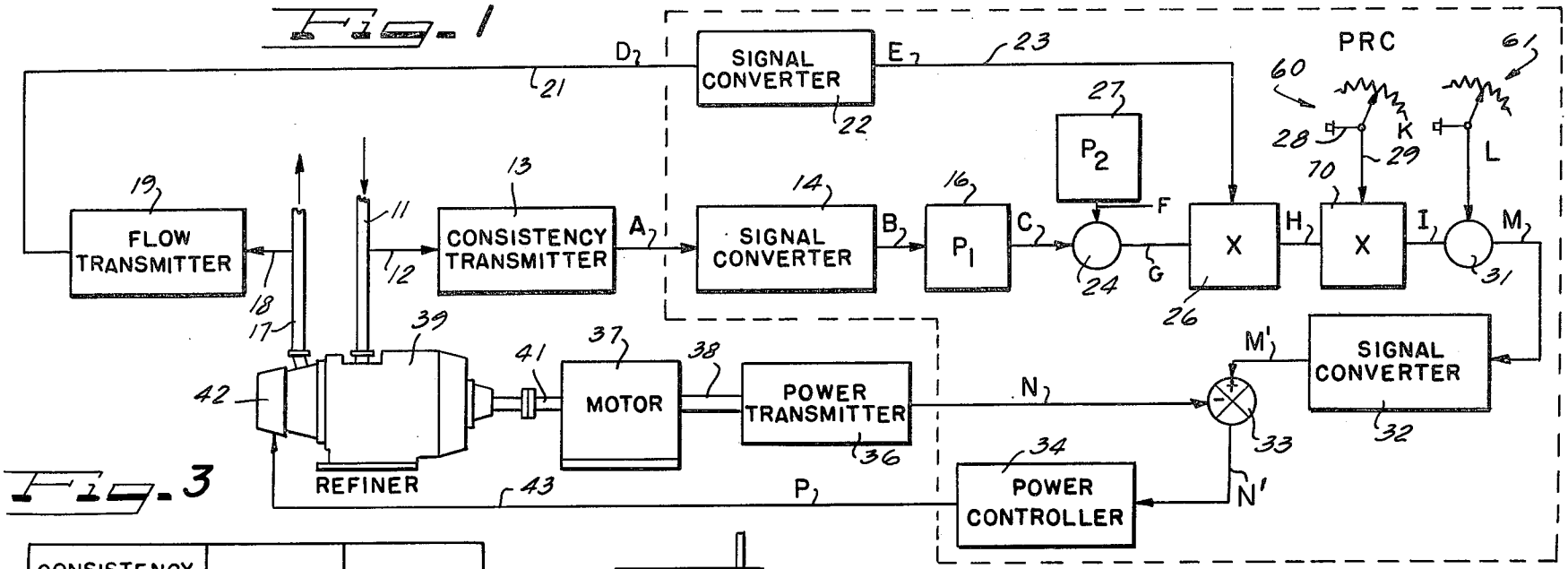
FIG. 1
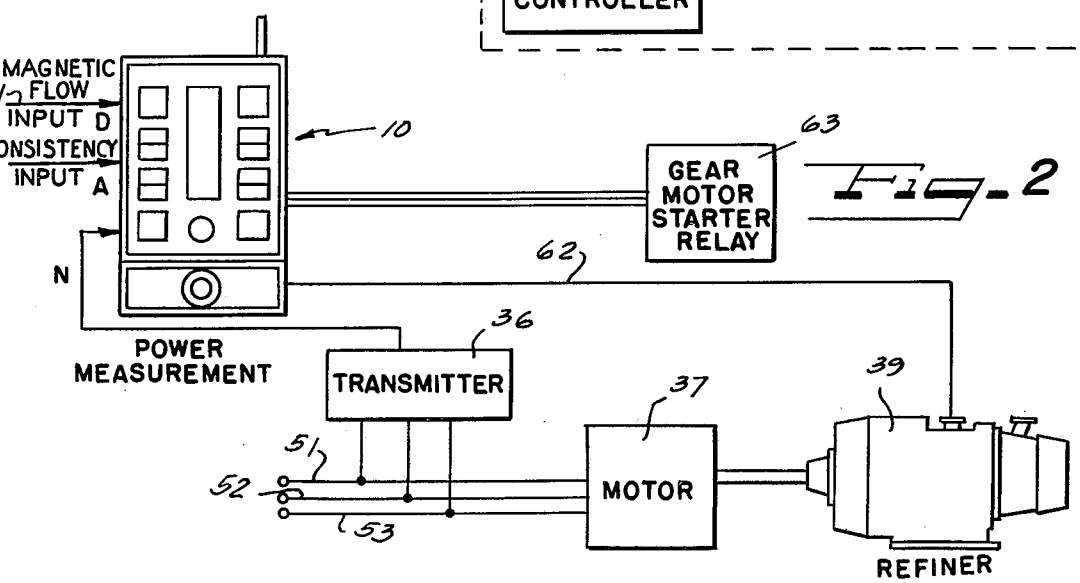
FIG. 2
| CONSISTENCY TRANSMITTER | $P_1$ | $P_2$ |
|---|---|---|
| 2.0 –3.5 | .00545 | .727 |
| 2.1 –3.6 | .00526 | .737 |
| 2.2 –3.7 | .00509 | .746 |
| 2.3 –3.8 | .00492 | .754 |
| 2.4 –3.9 | .00476 | .762 |
| 2.5 –4.0 | .00462 | .769 |
| 2.6 –4.1 | .00448 | .776 |
| 2.7 –4.2 | .00435 | .783 |
| 2.8 –4.3 | .00423 | .789 |
| 2.9 –4.4 | .00411 | .795 |
| 3.0 –4.5 | .00400 | .800 |
| 3.1 –4.6 | .00387 | .805 |
| 3.2 –4.7 | .00380 | .810 |
| 3.3 –4.8 | .00370 | .815 |
| 3.4 –4.9 | .00361 | .820 |
| 3.5 –5.0 | .00353 | .824 |
FIG. 3

PROGRAMMABLE REFINER CONTROLLER

BACKGROUND OF THE INVENTION

1. Field of the Invention

This invention relates in general to control systems for a paper refiners and in particular to a novel programmable refiner controller.

2. Description of the Prior Art

U.S. patents such as U.S. Pat. No. 3,604,646 which issued on Sept. 14, 1971 assigned to the assignee of the present application and in which the inventors are Marion A. Keyes IV and John A. Gudaz and U.S. Pat. No. 3,654,075 which issued on Apr. 4, 1972 in which the inventors are Marion A. Keyes IV and John A. Gudaz assigned to the assignee of the present application disclose control systems for paper refiners and the disclosure in these patents is hereby incorporated by reference.

SUMMARY OF THE INVENTION

The present invention comprises a programmable refiner controller which utilizes a microprocessor, whereby it is desired to combine two mass flow inputs which together represent the total mass flow and to relate the total mass flow to a power set point resulting in uniform and equal changes in power with actual changes in mass of dry pulp. In the present invention this problem is solved by treating the flow input as a percentage value BCD since the flow meters range from zero to a maximum and the consistency input is converted to a factor because consistency transmitters have a range from a minimum value consistency to a maximum value. The factor is equal to 1 at 50% consistency transmitter output and is equal to the maximum consistency over the mean consistency at 100% consistency transmitter output. This produces a resulting set point representative of a percent of maximum tons per day of dry pulp and is used to control the power in kilowatts which is directly proportional to horse power applied to the drive motor of the refiner.

In the present invention, a microprocessor which has a programmable read only memory is utilized and the memory routine controls the microprocessor so that for each input it operates so as to properly control the power applied to the system.

Thus, the invention comprises an automatic controller which can also be adapted for operation with consistency transmitters of different ranges so as to provide accurate control.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

BRIEF DESCRIPTION OF THE DRAWINGS

FIG. 1 is a block diagram of the programmable refiner controller of the invention;

FIG. 2 is a block diagram in greater detail of a portion of the apparatus; and

FIG. 3 is a table giving constant values for different transmitter.

DESCRIPTION OF THE PREFERRED EMBODIMENTS

FIG. 1 illustrates a motor 37 which drives through its output shaft 41 and a clutch, a refiner 39 which might be, for example a paper refiner such as described in U.S. Pat. No. 3,654,075. The refiner has a suitable beater element. The fluid stock enters the refiner 39 through an inlet conduit 11 and is discharged through an outlet conduit 17 and the heavy fiber stock which has been refined that moves through the conduit 17 is forwarded to the paper making machine where it is made into paper. The refiner 39 includes rotary and stationary disk elements which based upon the position between them as determined by a positioning mechanism 42 that moves these elements relative to each other determines the amount of refining work applied to the stock.

The consistency transmitter 13 receives an input 12 from conduit 11 and produces an output signal A indicative of the consistency of the stock in the conduit 11. A flow transmitter 19 receives an input 18 from the conduit 17 and produces an output signal on line 21 indicative of the flow through the conduit 17 of the stock.

The outputs of the flow transmitter 19 and the consistency transmitter 13 are supplied to a programmable refiner controller designated generally as 10 which includes the signal converter 14. The signal converter 14 changes the input analog signal A to a signal B which represents the percentage full scale of the transmitter 13. For example, if the transmitter range is 4—20 milliamperes and the measured signal is 12 milliamperes the output of the converter 14 will be 50. If the measured signal changes to 20 milliamperes, the output will change to 100. Thus, the output signal B is indicative of the percentage full scale of the transmitter 13. The signal converter 22 performs a similar function on the flow measurement signal D appearing on lead 21 and converts it into a percentage flow signal E that is supplied to lead 23. After the signal has been converted to a percentage signal, the consistency signal B is transformed to a mass factor by multiplying the signal B by an adjustable constant P1 in the multiplier 16 to obtain a signal C. The signal C is supplied to an adder 24 which receives another adjustable constant P2 from the constant generator 27 and the output of the adder 24 comprises a signal G. The signal G is multiplied in multiplier 26 with the representative percentage flow signal E which produces an output signal H which represents the tons per day flow through the refiner 39.

The resultant tons per day signal H is multiplied in the multiplier 70 with a signal obtained from a set point potentiometer 60 which is controlled by a knob 28 which sets the net kilowatts per day per ton. This set point is scaled in HPD/T net as shown in the following scaling sheet.

| Ratio Set Point Potentiometer Signal Output 29 | Net Horsepower-Days Per Ton |
|---|---|
| .00 | .00 |
| .05 | .18 |
| .10 | .36 |
| .15 | .54 |
| .20 | .71 |
| .25 | .89 |
| .30 | 1.07 |
| .35 | 1.25 |
| .40 | 1.43 |
| .45 | 1.61 |

-continued

| Ratio Set Point Potentiometer Signal Output 29 | Net Horsepower-Days Per Ton |
|---|---|
| .50 | 1.79 |
| .55 | 1.97 |
| .60 | 2.14 |
| .65 | 2.32 |
| .70 | 2.68 |
| .80 | 2.86 |
| .85 | 3.04 |
| .90 | 3.22 |
| .95 | 3.40 |
| 1.00 | 3.57 |
| 1.09 | 3.75 |
| 1.10 | 3.93 |
| 1.15 | 4.11 |
| 1.20 | 4.29 |
| 1.25 | 4.47 |
| 1.30 | 4.65 |
| The motor connected gross horsepower has been exceeded. | |
| 1.40 | 5.00 |
| 1.45 | 5.18 |
| 1.50 | 5.36 |

Specifically, the Ratio Set Point Potentiometer produces a signal multiplier ranging from 0.0 to 3.0 and will then be scaled according to the maximum Net Horsepower of the motor 37 divided by the maximum flow from flow transmitter 19 and the maximum stock consistency as can be measured by the consistency transmitter 13. These maximum values produce a maximum net horsepower per bone dry ton of paper pulp which is attainable, due to the limits of the installed system hardware, and is in turn scaled linearly with respect to the Ratio Set Point Potentiometer scale. Therefore, the Ratio Set Point Potentiometer 60 controls the gain of the signal H to arrive at a value of net KW per day per ton.

An adder 31 adds to the signal I the no-load KW signal which can be obtained from a variable potentiometer 61 that can be set to provide a signal representative of the percent no-load kilowatts of the total system gross kilowatts. The output of the adder 31 now comprises a signal M indicative of the gross kilowatts. The signal M is in percent and is received by signal converter 32 which changes this percent gross kilowatt signal M to an analog signal M' for comparison with the actual power measurement signal N. Signal N is received from a power transmitter 36 coupled to the motor 37 by shaft 38. Comparator 33 produces an output N' which is the difference between the signals N and M'. The power controller 34 senses the difference signal N' and provides a corrective signal P which is supplied to the refiner adjusting mechanism 42.

It is essential that in combining the two flow and consistency signals, that a mass factor be derived from the consistency signal, because in obtaining a mass flow signal we are combining flow which is measured from zero to maximum and consistency which is measured from a given minimum consistency to a maximum consistency. The consistency signal, because of its narrow span and non-zero minimum range, affects the total mass flow to a much lesser degree than the flow signal. The consistency signal is not generated linearly in measurement units and therefore must be compensated for by using the mass factor method described. A specific example is given.

ASSUME (A) Flow at Time X=500 GPM
(B) Flowmeter calibration=0–1000 GMP, 4–20 MA output
(C) Consistency at Time X=3.75
(D) Consistency Transmitter Cal.=3.0–4.5, 4–20 MA output
(E) T/D at Time X=500 GMP×3.75×0.06=112.5 T/D
(F) Available HP=600 HP
(G) No-Load HP=60 HP
(H) Desired HPD/T (net)=3.57

USING PRC METHOD

1. Consistency Transmitter output at Time X=12 MA=50%
2. Flowmeter output at Time X=12 MA=50%
3. From FIG. 3 $P_1=0.004$
   $P_2=0.8$

REFERRING TO FIG. 1

Signal (A)=12 MA
Signal (B)=50
Signal (C)=(B)×$P_1$=50×0.004=0.2
Signal (F)=$P_2$=0.8
Signal (G)=(F)+(C)=0.8+0.2=1.0
Signal (D)=12 MA
Signal (E)=50
Signal (H)=(E)×(G)=50×1.0=50

| | |
|---|---|
| Signal (K) = | Refer to listing of Net HPD/T vs. Ratio<br>From that table at a desired net HPD/T, we need a ratio = 1.0<br>Therefore Signal K = 1.0 |

Signal (I)=(K)×(H)=1.0×50=50

$$\text{Signal } (L) = \frac{\text{No Load } KW}{\text{Full Meter Scale } KW} = \frac{45\ KW \times 100}{600\ KW} = 7.46\%$$

Signal (M)=(I)+(L)=50+7.46=57.46%

$$\text{Setpoint} = (\text{Signal } M\%) \times (\text{Range in } KW) = 57.46\% \times 600 = 344.76\ KW$$

$$\text{At time } X \text{ Gross } KWD/T = \frac{344.76\ KW}{112.5\ T/D} = 3.064\ KWD/T$$

$$\text{At time } X \text{ Gross } HPD/T = \frac{3.064\ KWD/T}{.746\ KW/HP} = 4.11 \text{ Gross } HPD/T$$

$$\text{Gross } HP = \frac{344.76\ KW}{.746} = 462.15\ HP \text{ (Gross)}$$

$$\text{Net } HP = 462.15\ HP \text{ Gross} - 60\ HP \text{ (no-load)} = 402.15 \text{ Net } HP$$

$$\text{Net } HPD/T = \frac{\text{Net } HP}{T/D} = \frac{402.15}{112.5} = 3.57 \text{ Net } HPD/T$$

FIG. 2 illustrates the PRC 10 and the inputs D, A and N. Power leads 51, 52 and 53 supply three phase power to the motor 37 and the transmitter 36 and lead 62 comprises output from the refiner of alarm signals that are supplied to the PRC 10. The gear motor starter relay 63 is also connected to the controller 10.

The PRC has been designed to solve all of the complex problems of meeting all the signal and measurement units conversion factors. Ultimately, it will be necessary to interface the PRC with systems other than the standard 1.5% consistency range transmitter. This can be done by simply solving for new constants based on the existing formulas and hardware.

$$P_1 = \frac{1 - P_2}{50} \text{ (Mult.)}\quad P_2 = \frac{\text{Min. Consistency}}{\text{Mean Consistency}} \text{ (Adder)}$$

The constants have the following ranges in P.R.C. prototype:

$P_1$=0.0001 to 0.0099 step 0.0001

$P_2$=0.01 to 0.99 step 0.01

The span and range of consistency transmitter affects $P_2$. Constant $P_2$ is solved for first and substituted into the equation for $P_1$, $P_2$ will never be out of range unless the consistency transmitter range has 0.0% consistency as a minimum. $P_2$ will cause $P_1$ to fall out of range if the following exists.

$P_1$ is out of range if $0.50 > P_2 > 0.99$

Effectively causing $P_1$ to be >0.0099 or <0.0001. Specifically $P_2$ will cause $P_1$ to be out of range if the following relationship exists.

X=minimum consistency $$Y = \text{span} \qquad \text{If } X \leqq \frac{1}{2} Y$$

Therefore, as the minimum consistency of the consistency transmitter increases, the usable span can also increase and alternately as the minimum consistency of the transmitter decreases, the usable span must decrease if constants $P_2$ and $P_1$ are at the limits of their range as defined by the ranges given above.

Referring to the drawings, a signal (A) is derived from a measurement of consistency and is transmitted to a signal converter within the PRC module. The signal converter changes this analog signal (A) to a signal (B) representative of percent full scale of the transmitter.

For example: If the transmitter range is 4–20 MA and the measured signal is 12 MA, the output of the converter will be 50. If the measured signal changes to 20 MA, the output will change to 100.

The same function is performed on the flow measurement signal (D) resulting in a percent flow signal (E).

After the conversion to percent, the consistency signal (B) is transformed to a mass factor by multiplying an adjustable constant $P_1$ and adding to the result (C) another adjustable constant $P_2$. The adjustable constants $P_1$ and $P_2$ are derived from the consistency range of the particular transmitter used.

For example: Assume the range of the consistency transmitter is 3.0 to 4.5—

$$P_2 = \frac{\text{Minimum Consistency}}{\text{Mean Consistency}} = \frac{3.0}{3.75} = .8$$

$$P_1 = \frac{1 - P_2}{50} = \frac{1 - .8}{50} = \frac{.2}{50} = .004$$

These constants are derived for each transmitter range encountered. FIG. 3 comprises a summary table of values of $P_1$ and $P_2$ vs. transmitter range.

Although the invention has been described with respect to preferred embodiments, it is not to be so limited as changes and modifications can be made which are within the full intended scope of the invention as defined by the appended claims.

I claim as my invention:

1. An apparatus for controlling a paper refiner with a load control for processing paper stock including a motor driving said refiner, comprising a consistency transmitter having a predetermined output signal range for measuring the consistency of the paper stock at the refiner and producing an analog signal, a flow transmitter for measuring flow of paper stock through said refiner, a first signal converter receiving the output of said consistency transmitter and converting it into a signal indicative of the percentage of full scale of said consistency transmitter, a first multiplier receiving the output of said first signal converter and multiplying it by a first constant $P_1$ that is determined by the signal range for the particular consistency transmitter, an adder receiving the output of said first multiplier and adding to it a signal proportional to a second constant determined by the signal range for the particular consistency transmitter, a second signal converter connected to said flow transmitter and converting it into a signal indicative of percentage of full range of said flow transmitter, and a second multiplier receiving the outputs of said second converter and said adder and multiplying them together to obtain a signal indicative of tons of material per day flowing through said refiner.

2. An apparatus according to claim 1 including a third multiplier receiving the output of said second multiplier, and a first signal source setable to a desired kilowatt per day per ton supplying an input to said third multiplier.

3. An apparatus according to claim 2 including a second adder which receives the output of said third multiplier, and a second signal source setable to produce a signal representative of percent no-load kilowatt divided by full scale kilowatts and supplying an input to said third multiplier.

4. An apparatus according to claim 3 including a third signal converter receiving the output of said second adder and converting it from a percent gross kilowatt signal to an analog signal, said third signal converter supplying an input to said comparator, and a power transmitter connected to said motor to measure motor output, a comparator receiving the output of said power transmitter and said third signal converter, and a power controller connected to said comparator and supplying an input to said load control of said refiner.

5. An apparatus according to claim 2 wherein said first signal source is a variable potentiometer.

6. An apparatus according to claim 3 wherein said second signal source is a variable potentiometer.

* * * * *